US005257564A

United States Patent [19]

Janowski

[11] Patent Number: 5,257,564

[45] Date of Patent: Nov. 2, 1993

[54] FORMING OF CUTTING EDGES BY THE CONTROLLED GRAPHITIZATION OF DIAMOND

[76] Inventor: Leonard J. Janowski, 1-1 South Meadow Village, Carver, Mass. 02330

[21] Appl. No.: 909,207

[22] Filed: Jul. 6, 1992

[51] Int. Cl.[5] ..... B21K 11/00

[52] U.S. Cl. ..... 76/104.1; 76/DIG. 8

[58] Field of Search ..... 76/DIG. 12, DIG. 8, 76/101.1, 104.1, 103, 118

[56] References Cited

U.S. PATENT DOCUMENTS 2,281,975 5/1942 Hill ..... 76/DIG. 8

4,533,812 8/1985 Lorenz ..... 76/DIG. 12

5,058,562 10/1991 Tsutsui et al. ..... 76/DIG. 12

FOREIGN PATENT DOCUMENTS 1544130 4/1979 United Kingdom ..... 76/104.1

*Primary Examiner*—Roscoe V. Parker

[57] ABSTRACT

This disclosure relates to cutting instruments employing wedge-shaped cutting edges such as axes, knives, chisels and especially razor blades, said cutting edges being formed of diamond which has been shaped by contacting it with a moving, diamond surface under conditions of pressure and velocity sufficient to thermally convert a portion of the diamond on the cutting edge to softer forms of carbon.

11 Claims, 1 Drawing Sheet

FORMING OF CUTTING EDGES BY THE CONTROLLED GRAPHITIZATION OF DIAMOND

BACKGROUND OF THE INVENTION

The present invention relates to cutting instruments employing wedge-shaped cutting edges such as axes, knives, chisels and especially razor blades, said cutting edges being formed of diamond which has been shaped by contacting it with a moving, diamond surface under conditions of pressure and velocity sufficient to thermally convert a portion of the diamond on the cutting edge to softer forms of carbon.

The formation of cutting edges on steel razor blades conventionally involves a series of grinding and honing operations to produce a sharp and relatively durable shaving edge. Each grinding operation forms a facet on the blade edge being sharpened, which facet is modified by subsequent grinding operations of increasing fineness. Generally, the finished blade edge is wedge-shaped, having an included solid angle about 18°-26°. The faces or sides of the cutting edges may extend back from the ultimate edge a distance of up to 0.1 inch or even more. Each face is typically made up of two or more facets formed by the successive grinding and honing operations recited above. The final facet, i.e. the facet immediately adjacent the ultimate edge has a width as low as 7.5 microns or even less compared to the diameter of beard hair which ranges from 100-125 microns The steel of which the blade edge is composed may be either carbon steel or stainless steel In either case it is hardened by a suitable process, as by heat treating or working.

During the honing of the final facet, deflection of the steel blade strip in the sharpening machine together with the mechanical interaction between the steel and the abrasive particles of the grinding wheel produce a final facet which is usually not planar but slightly convex. The curvature is a function of the type of steel and grinding wheel employed, as well as the setting parameters of the sharpening machine. Because of the resulting convexity of the final facets on each side of the blade, the blade tip cross section of the ultimate edge is customarily referred to as "Gothic arched". Through shave test evaluation and measurement of the geometry of such sharpened cutting edges, it has been found that the ultimate edge should have an average tip radius of less than about 500 angstroms. Typically, a shave facilitating layer of an organic polymeric material is applied to the area of the blade adjacent the ultimatef edge. Useful materials are described, inter alia, in U.S. Pat. Nos. 2,937,967; 3,071,858 and 3,071,856.

More recent studies have shown that the shaving performance of razor blades can be significantly improved if the thickness of the cutting edge over a distance back from the ultimate edge is substantially less than that of traditionally manufactured blades. The minimum useful thickness of the blade over the first 40 microns back from the ultimate edge is determined by the nature of the blade material. For example, for the types of steel currently used, the blade needs to be at least about 0.7 micron thick at a distance of about 1.0 micron from the blade edge in order to have sufficient strength to withstand the bending forces on the edge occurring during the shaving process, forces which can cause the edge to deform plastically or fracture in a brittle fashion, depending on the mechanical properties of the blade material.

In an attempt to develop blades of reduced thickness over the first 40 microns back from the ultimate edge, the prior art suggests the use of harder blade materials such as titanium carbide, boron nitride and diamond. U.S. Pat. No. 4,720,918 states that in the case of diamond, for example, blade thicknesses in the critical region would be approximately 40% of those calculated for stainless steel. The patent, however, does not describe a method for manufacturing a blade having the thinner cutting edges which should be obtainable with harder materials such as diamond or diamond-like carbon.

A major problem is, of course, posed by the need to sharpen a diamond coated blade to the dimensions and blade profile discussed above. Since the only material hard enough to abrade a diamond surface is another diamond, it is necessary to employ diamond surfaced grinding tools or lapping processes using progressively finer sizes of diamond grit. Since the smallest partical grit size for abrading diamond is about one micron, a typical well-polished diamond surface exhibits one-half micron scratches. Such a result is unsuitable for the formation of an ultimate edge having an average tip radius of less than 500 angstroms.

PCT International Publication No. WO 87/04471 describes a method of forming such cutting edges by coating a preexisting cutting edge formed of steel or other substrate material with a material such as diamond, the coating being accomplished by a vapor deposition process. Simultaneously, the cutting edge is subjected to ion bombardment with ions of sufficient mass and energy to cause sputter removal of the deposited material at a rate which is less than the rate of deposition, thereby forming a cutting edge of diamond having the desired geometry.

PCT International Publication No. WO 90/03455 describes a method of forming or modifying the cutting edge of razor blades such as steel blades as they are being coated with diamond-like carbon on both sides of the edges.

A number of other non-abrasive methods for working diamond surfaces have been described in the prior art including the use of laser energy in a variety of applications. Among these are U.S. Pat. Nos. 3,527,198; 4,392,476; and 4,401,876. In U.S. Pat. No. 2,931,351 there is described a method of polishing a diamond by subjecting its surface to the action of a first flame having an excess of acetylene to heat it followed by subjecting it to the action of a second flame having an excess of oxygen to glaze the surface. Finally, U.S. Pat. No. 4,662,348 describes a method for burnishing complementary, conical, polycrystalline diamond bearing surfaces by rotating them at sufficient pressure and velocity to polish the bearing surfaces. None of these processes is directed at producing a result having the submicron dimensions required for the forming of a suitable razor blade cutting edge as described above.

BRIEF SUMMARY OF THE INVENTION

The present invention provides novel improved processes and apparatus for use in forming cutting edges, especially in razor blades; having an edge comprising diamond or diamond-like carbon. For purposes of this invention the term "diamond" will be understood to include the various forms of diamond-like carbon which are known to those skilled in the art. The cutting edge of the blade is formed by contacting the diamond comprising the edge with a rotating wheel having a smooth diamond contact surface, the rotational velocity of the wheel and the pressure of the wheel against the blade edge being sufficient to remove a portion of the diamond blade edge by graphitization.

In a preferred form of the invention the temperature generated by the friction between the diamond surfaces is controlled by providing water flow cooling. In an especially preferred form of the invention, both sides of the cutting edge are simultaneously formed by passing the diamond coated blade material through the nip formed by a pair of juxtaposed, rotating wheels having smooth diamond or diamond-like carbon contact surfaces, the rotational velocity of the wheels and the pressure of the wheels against the diamond coating being sufficient to remove portions of the diamond by graphitization. The process described herein will be referred to hereinafter as "graphitic sharpening".

DESCRIPTION OF THE PREFERRED EMBODIMENTS

As is well known, diamond is the hardest substance known. Because of this it is very difficult to work diamond surfaces to alter the shape created by nature or produced industrially in the case of synthesized diamond materials. Other materials can be worked by abrasive contact with harder materials but diamond is worked only by abrasive contact with another diamond material. Typical of these are the various sawing, grinding and lapping techniques employed in fashioning diamonds for jewelry. These processes have been extremely slow and expensive since large quantities of diamond abrasive material are consumed.

Industrial applications of these long-known abrasive techniques for working diamond surfaces are many and varied but suffer from the same drawbacks, i.e. extreme slowness and the excessive consumption of abrasive material. One application of conventional technology involves the polishing of pairs of complementary conical bearing surfaces faced with polycrystalline diamond. Such bearings can be ground and polished by relative rotation with the bearing surfaces engaged, using diamond grit as an abrasive between the bearing surfaces. The smoothing and mating of such bearing surfaces in this manner can take as long as three weeks for each bearing pair, consuming about 25 carats of diamond grit for each square inch of polished surface. Typically, conventional abrasive working of diamond surfaces begins with a relatively coarse grit, moving through successive stages employing progressively finer grit materials until the only remaining scratches are those produced by the finest grit material employed, the smoothest of such surfaces typically exhibiting one-half micron scratches.

Diamond is a somewhat unique material in many ways, one of these being its crystal structure which is thermodynamically metastable at ordinary temperatures and pressures. It is known that if diamond is heated in an inert gas to a temperature of about 1400°-1500° C. it will begin to spontaneously change to more stable, softer forms of carbon. This change can include recrystallization as graphite as well as the formation of amorphous carbon. For the purposes of this invention the conversion of diamond to softer, more stable forms of carbon will be referred to as "graphitization" whether the conversion product is graphite, amorphous carbon, or a mixture thereof. The temperature at which such conversion takes place can be less than the 1400°-1500° C. referred to above if the heating takes place in an oxidizing atmosphere such as air or if the diamond material being heated contains a catalytic metal in interstices of the diamond matrix such as might be produced by sintering polycrystalline synthetic diamond in the presence of a metal such as cobalt.

When any two solid surfaces in contact are moved with respect to each other, frictional heating occurs at the points of contact. The amount of heat energy produced is a function of the pressure at the contact surfaces, the relative velocity between the surfaces and the coefficient of friction of the surface materials. In the context of industrial bearings where the generation of heat by friction with consequent bearing wear is sought to be minimized, limiting conditions can be described by relating pressure, P, and linear velocity, v. In English units, pressure is typically expressed in pounds per square inch and velocity in feet per minute. Using such units, a dry carbon-graphite bearing has a limiting Pv of, about 15,000 foot pounds per square inch minute while a sintered bronze bearing impregnated with a lubricant may have a limiting Pv of 50,000 and still have a reasonable life.

If two diamond surfaces in contact with one another are moved with respect to each other, the heat generated will, as described above, be a function of the contact pressure and the relative velocity. With increasing Pv there approaches a point at which the temperature of the diamond surfaces is high enough to bring about graphitization. This invention comprises the application of this principle to the forming of wedge-shaped cutting edges in implements such as axes, knives, chisels, microtomes and especially razor blades which have been coated with diamond.

The area of a diamond cutting edge surface which is removed during the initial phases of graphitic sharpening depends upon how well or poorly the initial surfaces fit together. During initial phases, only the high areas of the blade surface to be smoothed will contact the smoother surface of the rotating, graphitizing wheel. The Pv of the process must be sufficient to frictionally heat the high areas to cause them to spontaneously convert to graphite. It is important however to control the temperature at the contact surfaces to limit the rate of graphitization thus preventing massive thermal degradation of the diamond coating material. This can be accomplished by non-steady state frictional heating or by employing a cooling fluid such as water to limit and control the temperature of the surface being graphitized.

As mentioned above, many bearings presently in use exhibit a limiting Pv of 15-50,000. In contrast, the Pv which is useful in the practice of this invention is at least about 1,000,000 and is preferably in the range of about 2,000,000-10,000,000. For a given Pv employed in the practice of this invention, the rate of cooling will influence the rate of graphitization. If too much coolant is used essentially no graphitization will occur. If there is inadequate cooling excessive thermal degradation may occur. The most rapid, controlled graphitization occurs when the cooling rate is only slightly higher than that required to prevent massive thermal degradation.

When water cooling is employed, film boiling may occur at the diamond surface, drastically reducing solid-liquid heat transfer leading to possible overheating and consequent degradation. If desired, the ambient pressure of the atmosphere surrounding the graphitization apparatus may be increased to raise the boiling point of the cooling water thus permitting the use of higher Pv conditions and more rapid, but controlled graphitization. The most rapid graphitization is obtained with an intermediate range of cooling where only nucleate boiling occurs at the diamond surface. It is believed that this optimum rate of extraction of heat permits the surface temperature to intermittently exceed the thermal degradation temperature yet maintains the bulk of the diamond being worked below the graphitization temperature. In controlling the flow of cooling water for a given Pv, it is important to begin with an excess of coolant and then gradually reduce the rate of flow until nucleate boiling occurs. Flow is then increased slightly to provide a margin of error to prevent inadvertent degradation of the cutting edge surface.

As the high points on the diamond cutting edge become reduced by graphitization, it may be necessary to increase the load between the diamond surfaces or their relative velocity or both to accomodate the fact that the contact areas are becoming larger as more material is being removed. Alternatively, Pv can be held constant and the cooling rate gradually decreased to effect continued graphitization. As the removal of the high points on the cutting edge being worked proceeds, pressure, velocity and cooling are controlled following the principles set forth above until the desired edge dimensions and geometry have been achieved, yielding a diamond edge free of surface scratches.

Broadly speaking, the above principles can be applied in the modification of conventional edge forming equipment to practice the method of this invention. In the case of razor blade sharpening equipment, an example of such is illustrated and described in U.S. Pat. No. 2,709,874 which is incorporated herein by reference for the purpose of illustrating and describing constructional details of this general type of apparatus and its use. It is to be understood that the metal razor blade strip which is sharpened by graphitization in the following discussions is made from any type of those types of steel known to be useful for the purpose. The pre-formed cutting edge is coated with diamond (including diamond-like carbon) by any of the vapor deposition processes known in the art, for example, the process disclosed in PCT International Publication No. WO 87/04471 at page 9, lines 8–23.

Referring to FIGS. 1*a*, 1*b* and 1*c* of U.S. Pat. No. 2,709,874 there is shown a coil of thin strip of blade steel 30 which is fed through a grinding station 32, a rough hone station 33, a finish hone station 34 and thence through a stropping station 36. The purpose of the first three of these stations is to progressively change the edge profile of the strip of blade steel 30 to form a cutting edge which is given a final polish at stropping station 36 which is generally similar to the grinding stations except that the stropping rolls are made of a material such as a leather rather than an abrasive composition and the rolls rotate in the opposite direction.

In each of the grinding stations there is employed a pair of opposed, parallel, abrasive rolls disposed longitudinally in the direction of the steel strip, abrasively removing metal from the edge of the strip as they rotate. Means for cooling the strip during the grinding process are described in col. 3, lines 40–65 and at col. 5, lines 51–71.

In adapting the grinding apparatus of U.S. Pat. No. 2,709,874 for use in the graphitic sharpening process of this invention it is necessary to replace the conventional abrasive grinding wheels with graphitizing wheels having smooth diamond surfaces. It is also necessary to employ means for adjusting the position of the grinding wheels with respect to the blade strip and for adjusting the load placed on the diamond edge material by the graphitizing wheel. Such means are described at col. 4, lines 25–73 and should be adapted to permit a Pv of at least 1,000,000 to be achieved at the points of contact between the diamond coated blade strip and the graphitizing wheel. The means for cooling the diamond coated blade edge at the area of graphitization alluded to above should have sufficient flow capacity to insure that the rate of graphitization can be controlled even at high Pv levels. Conventional means for controlling the speed of the diamond coated wheels may be employed, for example the use of an electric drive motor having a variable speed capability.

A preferred form of this invention contemplates the graphitic sharpening of a diamond coated steel blade strip in which the steel has been conventionally sharpened prior to coating, the cross-sectional shape of the sharpened edge comprising a Gothic arch shape having opposed, convex facet surfaces such as that shown in FIG. 6 of U.S. Pat. No. 3,461,616. By limiting the thickness of the vapor deposited coating so as to retain the curvature of the surface of the substrate, the load exerted by the graphitizing wheel against the coated edge necessary to produce a Pv of at least 1,000,000 is reduced because the area of contact between the two curved diamond surfaces is reduced, being essentially a line. Apparatus designed to grind conventional blade edges to a crosssectional, Gothic arched shape is illustrated and described in U.S. Pat. Nos. 3,461,616 and 4,916,817, both of which are incorporated by reference for the purpose of illustrating and describing the general type of apparatus and its use. Apparatus of the type described in these patents may be adapted as described below for use in practicing the graphitic sharpening process of this invention to produce a sharpened, diamond coated blade having curved edge facets.

These patents describe types of razor blade sharpening apparatus employing pairs of conventional grinding or honing wheels of a modified frustoconical configuration mounted for rotation about parallel axes inclined at a variable tilt angle relative to a blade path defined by a blade holder. Each wheel has an axial length defining an entry end and an exit end with the wheels being arranged and adapted to concurrently contact the opposed surfaces at progressively changing angles of contact as the opposed surfaces are moved from the entry end to the exit end, thereby forming a facet on each of the opposed surfaces. Illustrations of such equipment are found in FIGS. 2–4 in U.S. Pat. No. 3,461,616 and in FIGS. 2–4 in U.S. Pat. No. 4,916,817.

A spiral helix formed on the surface of each wheel defines a series of lands that are interengaged to define a nip when the wheels are juxtaposed in grinding or honing position. The use of the apparatus as described in the two patents produces, in a conventional steel razor blade, a smoothly curved cutting edge of optimum dimensions and geometry.

The adaptation of the apparatus of these two patents to the method of this invention primarily involves the provision of graphitic sharpening wheels having smooth diamond surfaces in place of the conventional abrasive wheels described therein for the removal of metal. Referring to U.S. Pat. No. 3,461,616; FIGS. 2–4 show honing wheels 28 manufactured of a suitably fine grade of abrasive material such as silicon carbide, alumina, diamond, or a combination of such materials. As mentioned hereinabove, the only conventional abrasive material capable of altering the shape of a diamond surface is a diamond abrasive, and then it is accomplished only very slowly. The apparatus can be employed however in the graphitic sharpening process by using wheels of the shape described in the patent but in which lands 50 bear a smooth diamond surface in place of the fine grade of abrasive. It is preferred in the practice of this invention to use a wheel bearing a smooth, polycrystalline diamond surface, i.e. diamond with a continuous network of diamond to diamond bonding, in contrast to a surface containing diamond made by infiltration techniques in which individual diamond crystals are set in a metal or metal carbide matrix because the latter is less able to maintain surface integrity under the high Pv conditions of graphitic working of diamond cutting edges. Where the blade edge coating to be graphitically sharpened comprises diamond-like carbon or a mixture thereof with diamond rather than pure diamond, it is of course possible to employ smooth surfaced graphitization wheels of similar composition as long as the hardness of the wheels is not significantly less than that of the edge coating.

In further adapting the apparatus of U.S. Pat. No. 3,461,616 for use in graphitic sharpening it is necessary to insure that there is sufficient range in the speed of rotation of the wheels 28 and in the load which can be placed on upper edge 12 of razor blade 10 at the nip 52 defined by the intersection of the interengaged wheel lands to produce a Pv of at least 1,000,000 at the contact surface of upper edge 12. Conventional arrangements for cooling strip 10 and wheels 28, preferably with water, must be provided to insure control of the temperature of the surface being worked, as discussed hereinabove. The flow of coolant should be sufficient to maintain the temperature at or below the graphitization temperature at Pv values up to about 10,000,000 foot pounds per square inch minute.

In practicing the method of this invention, it is advantageous to insure that the smooth diamond coating on the rotating wheels remains below the graphitization temperature of the coating. While the mass of the wheel substrate material itself coupled with the inherently good, thermal conductivity of the coating may be sufficient to minimize graphitization of the wheels, the wheels may be provided with sufficient dedicated water flow cooling to eliminate the possibility.

While the above description is based upon the details of various conventional forms of cutting edge forming equipment described in the various prior art patents alluded to in the description, it is to be understood the principle of graphitic sharpening may be practiced equally using other forms of apparatus so long as the conditions of Pv and temperature control are met.

I claim:

1. In a method for forming facets on opposed surfaces terminating at an edge of a cutting instrument, said opposed surfaces comprising diamond, diamond-like carbon or a mixture thereof, the improvement comprising the step of contacting said opposed surfaces with juxtaposed rotating wheels having smooth contact surfaces coated with diamond, diamond-like carbon and mixtures thereof, the rotational velocity of said wheels and the contact pressure of said wheels against said opposed surfaces being sufficient to remove a portion of said opposed surfaces by a process of graphitization.

2. A method of claim 1 wherein the rate of graphitization is controlled by contacting said opposed surfaces with a water flow while they are being subjected to said process.

3. A method of claim 2 wherein a rate of said water flow is selected to provide nucleate boiling at the points of graphitization.

4. A method of claim 1 wherein the Pv exceeds about 1,000,000 foot pounds per square inch minute.

5. A method of claim 2 wherein a water flow also contacts said rotating wheels at a rate sufficient to maintain the temperature of the surfaces of said wheels below the graphitization temperature.

6. In a method for forming convex facet surfaces on opposed surfaces terminating at an edge of a cutting instrument, said opposed surfaces comprising diamond, diamond-like carbon or a mixture thereof, the improvement comprising the step of contacting said opposed surfaces with juxtaposed rotating wheels having smooth contact surfaces coated with diamond, diamond-like carbon or a mixture thereof, each wheel having an axial length defining an entry and an exit end, said wheels being arranged and adapted to concurrently contact said opposed surfaces at progressively changing angles of contact as said opposed surfaces are moved from said entry end to said exit end to thereby form a facet on each of said opposed surfaces, the rotational velocity of said wheels and the contact pressure of said wheels against said opposed surfaces being sufficient to remove a portion of said opposed surfaces by a process of graphitization.

7. A method of claim 6 wherein the rate of graphitization is controlled by contacting said opposed surfaces with a water flow while they are being subjected to said process.

8. A method of claim 7 wherein a rate of said water flow is selected to provide nucleate boiling at the points of graphitization.

9. A method of claim 6 wherein the Pv exceeds about 1,000,000 foot pounds per square inch minute.

10. A method of claim 7 wherein a water flow also contacts said rotating wheels at a rate sufficient to maintain the temperature of the surfaces of said wheels below the graphitization temperature.

11. In a method for sharpening a steel razor blade, the cutting edge of which has been coated with a hard layer of diamond, diamond-like carbon or a mixture thereof, the improvement comprising contacting said cutting edge with a rotating wheel bearing a smooth coating of diamond, diamond-like carbon or a mixture thereof, the rotational velocity of said wheel and the contact pressure of said wheel against said cutting edge being sufficient to remove a portion of said hard layer by a process of graphitization.

* * * * *

UNITED STATES PATENT AND TRADEMARK OFFICE

CERTIFICATE OF CORRECTION

PATENT NO. : 5,257,564

DATED : November 2, 1993

INVENTOR(S) : Leonard J. Janowski

It is certified that error appears in the above-indentified patent and that said Letters Patent is hereby corrected as shown below:

Col. 3, line 20, Insert the following--

Figure 4:
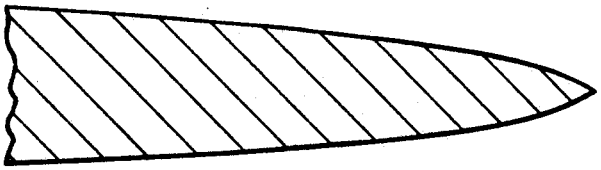
Fig. 4 is a diagram of the configuration of one form of a sharpened edge of a razor blade sharpened in accordance with the invention. ... --

Col. 6 line 24,
delete "616." and insert ... 616 reproduced herein, in part, as Fig. 4 ...

Figure 1:
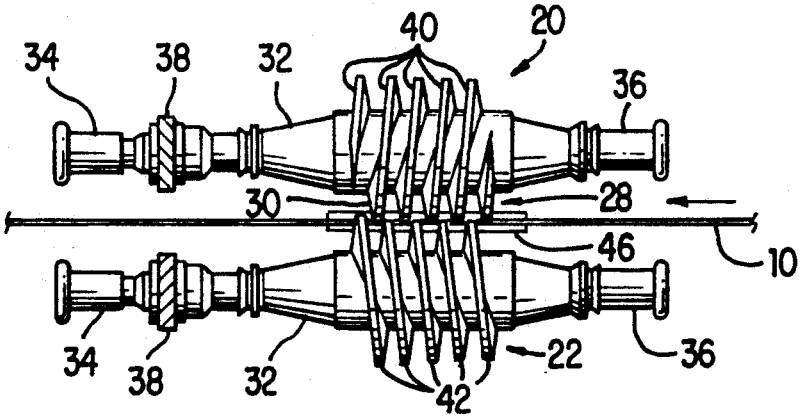
Fig. 1 is a diagramatic top view of two graphitic sharpening wheels employed in the preferred practice of the invention.
Figure 2:
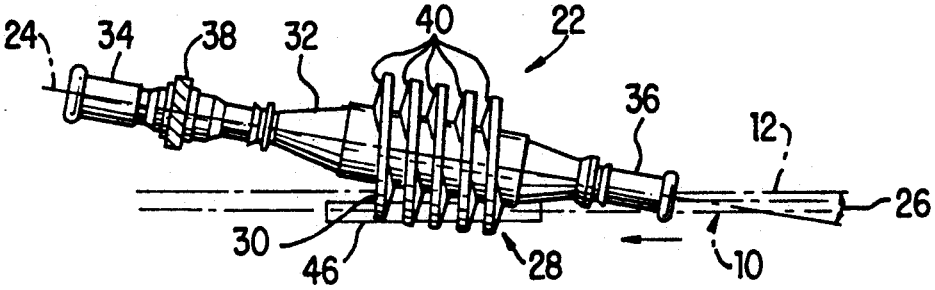
Fig. 2 is a diagramatic side view of the graphitic sharpening wheels of Figs. 1.
Figure 3:
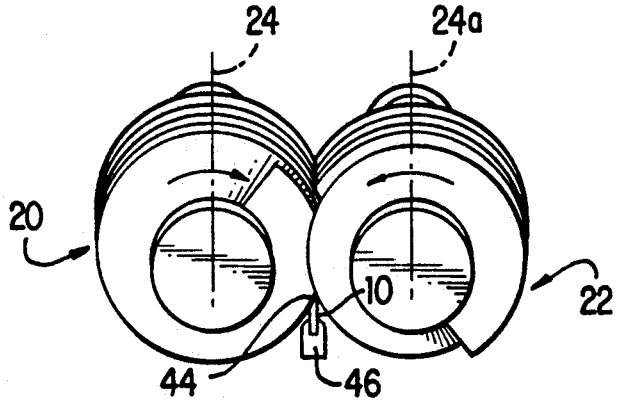
Fig. 3 is a diagramatic right end view of the graphitic sharpening wheels of Fig. 1.

Col. 6, line 54, insert the following--
The latter are reproduced herein, in part, as Figs. 1-3. --

Col. 6, lines 55-58,
delete the entire sentence through the word "position" in line 58.

UNITED STATES PATENT AND TRADEMARK OFFICE

CERTIFICATE OF CORRECTION

PATENT NO. : 5,257,564

DATED : November 2, 1993

INVENTOR(S) : Leonard J. Janowski

It is certified that error appears in the above-indentified patent and that said Letters Patent is hereby corrected as shown below:

Col. 6, line 59, after "patents" insert ... and in Figs. 1-3 herein ...

Col. 6, line 61, delete "." and add ... one form of which is shown in Fig. 4 herein ...

Col. 6, line 64, after "wheels" insert ... 20, 22 in Figs. 1-3 herein ...

Col. 6, line 66, delete "therein" and insert ... in the patents ...

Col. 7, line 8, after "patent" insert ... and shown herein in Figs. 1-3 ...

Col. 7, line 29, delete "28" and insert ... 20, 22 shown herein in Figs. 1-3 ...

Col. 7, line 30, delete "52" and insert ... 44 ...

UNITED STATES PATENT AND TRADEMARK OFFICE

CERTIFICATE OF CORRECTION

PATENT NO. : 5,257,564

DATED : November 2, 1993

INVENTOR(S) : Leonard J. Janowski,

It is certified that error appears in the above-indentified patent and that said Letters Patent is hereby corrected as shown below:

Col. 7, line 32, after "lands" insert ... 40 ...

Col. 7, line 34, delete "28" and insert ... 20, 22 ...

Signed and Sealed this

Tenth Day of January, 1995

Bruce Lehman

*Attest:*

BRUCE LEHMAN

*Attesting Officer*

*Commissioner of Patents and Trademarks*